US012247391B2

(12) United States Patent
Neill

(10) Patent No.: US 12,247,391 B2
(45) Date of Patent: Mar. 11, 2025

(54) CONCRETE VOID FORM AND METHOD OF MODULAR CONSTRUCTION THEREWITH

(71) Applicant: ANC Capital Inc., Brantford (CA)

(72) Inventor: Andrew Neill, Brantford (CA)

(73) Assignee: ANC Capital Inc., Brantford (CA)

( * ) Notice: Subject to any disclaimer, the term of this patent is extended or adjusted under 35 U.S.C. 154(b) by 7 days.

(21) Appl. No.: 18/127,855

(22) Filed: Mar. 29, 2023

(65) Prior Publication Data

US 2023/0340775 A1 Oct. 26, 2023

Related U.S. Application Data

(60) Provisional application No. 63/398,090, filed on Aug. 15, 2022, provisional application No. 63/334,167, filed on Apr. 24, 2022.

(51) Int. Cl.
*E04B 1/348* (2006.01)

(52) U.S. Cl.
CPC ..... *E04B 1/3483* (2013.01)

(58) Field of Classification Search
CPC ..... E04B 1/3483; E04B 1/34807; E04B 1/34815; E04B 2001/2496; E04B 1/161; E04B 2/86; E04B 1/34853
USPC ..... 52/79.1, 79.7, 79.11, 79.12, 79.13, 79.14
See application file for complete search history.

(56) References Cited

U.S. PATENT DOCUMENTS 3,751,864 A * 8/1973 Berger ..... E04B 1/348 52/745.03
3,990,193 A * 11/1976 Ray ..... E04B 1/34823 52/79.14
4,138,833 A * 2/1979 Townend ..... E04H 1/005 52/79.14
4,364,206 A * 12/1982 Wybauw ..... E04B 1/3483 52/79.9
4,599,829 A * 7/1986 DiMartino, Sr. ..... E04B 1/3483 52/106
4,854,094 A * 8/1989 Clark ..... E04B 1/3483 52/234

(Continued)

FOREIGN PATENT DOCUMENTS

CA 2801287 C 12/2011

OTHER PUBLICATIONS

Vulcraft, "REDICOR Modular Steel Form System by Vulcraft", Nucor Vulcraft, <https://vulcraft.com/Products/Redicor>.

*Primary Examiner* — Paola Agudelo
*Assistant Examiner* — Adam G Barlow
(74) *Attorney, Agent, or Firm* — Heer Law; Stephano Salani

(57) ABSTRACT

The present specification relates generally to modular construction and more specifically to a sacrificial concrete void form and method of modular construction therewith. The concrete void form includes a steel frame having a top face, a bottom face, and four side faces, wherein at least one of the four side faces and the top face are covered with at least one sheet of corrugated steel decking. The method of modular construction includes constructing at least one concrete void form, the at least one concrete void form comprising a steel frame having a top face, bottom face and four side faces, wherein at least one of the four side faces and the top face are covered with at least one sheet of corrugated steel decking, installing the at least one concrete void form at a construction site, and pouring concrete over or adjacent to the at least one concrete void form.

9 Claims, 5 Drawing Sheets

(56) References Cited

U.S. PATENT DOCUMENTS 5,220,765 A * 6/1993 Kubik ..... E04B 1/19 52/650.1
6,032,421 A * 3/2000 Yamada ..... E04G 21/161 220/4.26
6,038,824 A * 3/2000 Hamrick, Sr. ..... E04B 1/3483 52/143
6,393,776 B1 * 5/2002 Waller ..... E04H 9/14 52/741.12
6,675,540 B1 * 1/2004 Rokes ..... E04B 1/34336 52/630
7,941,984 B2 * 5/2011 Roig ..... E04B 1/34838 52/634
8,484,929 B1 * 7/2013 Begdouri ..... B65D 88/76 52/745.03
9,702,138 B1 * 7/2017 Rutherford ..... E04B 1/34853
10,907,342 B1 * 2/2021 Parkhouse ..... F16B 7/182
11,276,323 B1 * 3/2022 Kirchner ..... G09B 9/00
11,767,667 B2 * 9/2023 Ballew ..... E04B 1/34807 52/79.12
2007/0044392 A1 * 3/2007 LeBlang ..... E04B 1/161 52/79.11
2008/0134589 A1 * 6/2008 Abrams ..... E04B 1/34807 52/79.1
2013/0019542 A1 * 1/2013 Bishop ..... E04H 9/14 52/79.11
2014/0259978 A1 * 9/2014 Walton ..... H01Q 1/44 52/79.8
2014/0298745 A1 * 10/2014 Rechenmacher ..... E04H 1/005 52/425
2018/0119421 A1 * 5/2018 Pospisil ..... E04B 9/245
2020/0240159 A1 * 7/2020 Grada ..... E04H 1/02
2021/0123229 A1 * 4/2021 O'Brien ..... E04B 1/3483
2021/0246648 A1 * 8/2021 Mullaney ..... E04H 1/04
2021/0317652 A1 * 10/2021 Kim ..... E04B 1/34326
2022/0002991 A1 * 1/2022 Austin ..... E04B 1/6807
2022/0205235 A1 * 6/2022 Chapman ..... E04B 1/3483
2023/0183994 A1 * 6/2023 Herring ..... E04H 4/005 4/513
2023/0272612 A1 * 8/2023 Pospisil ..... E04B 1/24 52/270

* cited by examiner

CONCRETE VOID FORM AND METHOD OF MODULAR CONSTRUCTION THEREWITH

FIELD OF THE INVENTION

The present specification relates generally to modular construction and more specifically to a sacrificial concrete void form and method of modular construction therewith.

BACKGROUND OF THE INVENTION

Modular construction is becoming increasing popular, due in large part to advantages over traditional construction including time-savings, fewer weather-based delays, a reduced need for on-site storage of materials, lower labor costs, and lower waste volume. Although modular construction invariably reduces the amount of time required for the construction of a given structure, a substantial amount of time is still involved at the on-site assembly stage. Often, structures built from pre-constructed modules require a concrete superstructure for structural, seismic, high wind, sound and fire rating requirements. The construction of that superstructure necessarily involves concrete forming.

Currently, there are a number of solutions for conventional concrete forming, especially in midrise and high-rise construction, but these solutions fail to meet the needs of the industry because they require concrete forming, form stripping and/or reshoring. These solutions are therefore expensive, wasteful and time consuming, as well as being very dangerous for workers and the general public in the area of the construction site. These solutions are also ineffective in circumstances where poured concrete superstructures are required in a timely manner, for example after natural disasters like tornadoes, hurricanes, earthquakes, tsunamis, or pandemics or after manmade disasters like war, where hospitals and housing must be constructed quickly.

The benefit and value of modular construction today is therefore curbed by the need for a concrete superstructure and the protracted, tedious manner in which this concrete superstructure is provided.

Accordingly, there remains a need for improvements in the art.

SUMMARY OF THE INVENTION

In an embodiment of the present invention, there is provided a concrete void form comprising a steel frame having a top face, a bottom face, and four side faces, wherein at least one of the four side faces and the top face are covered with at least one sheet of corrugated steel decking.

According to another embodiment, there is provided a method of modular construction comprising constructing at least one concrete void form, the at least one concrete void form comprising a steel frame having a top face, bottom face and four side faces, wherein at least one of the four side faces and the top face are covered with at least one sheet of corrugated steel decking; installing the at least one concrete void form at a construction site; and pouring concrete over or adjacent to the at least one concrete void form.

Other aspects and features according to the present application will become apparent to those ordinarily skilled in the art upon review of the following description of embodiments of the invention in conjunction with the accompanying figures.

BRIEF DESCRIPTION OF THE DRAWINGS

The principles of the invention may better be understood with reference to the accompanying figures provided by way of illustration of an exemplary embodiment, or embodiments, incorporating principles and aspects of the present invention, and in which.

DETAILED DESCRIPTION OF THE EMBODIMENTS

Figure 1:
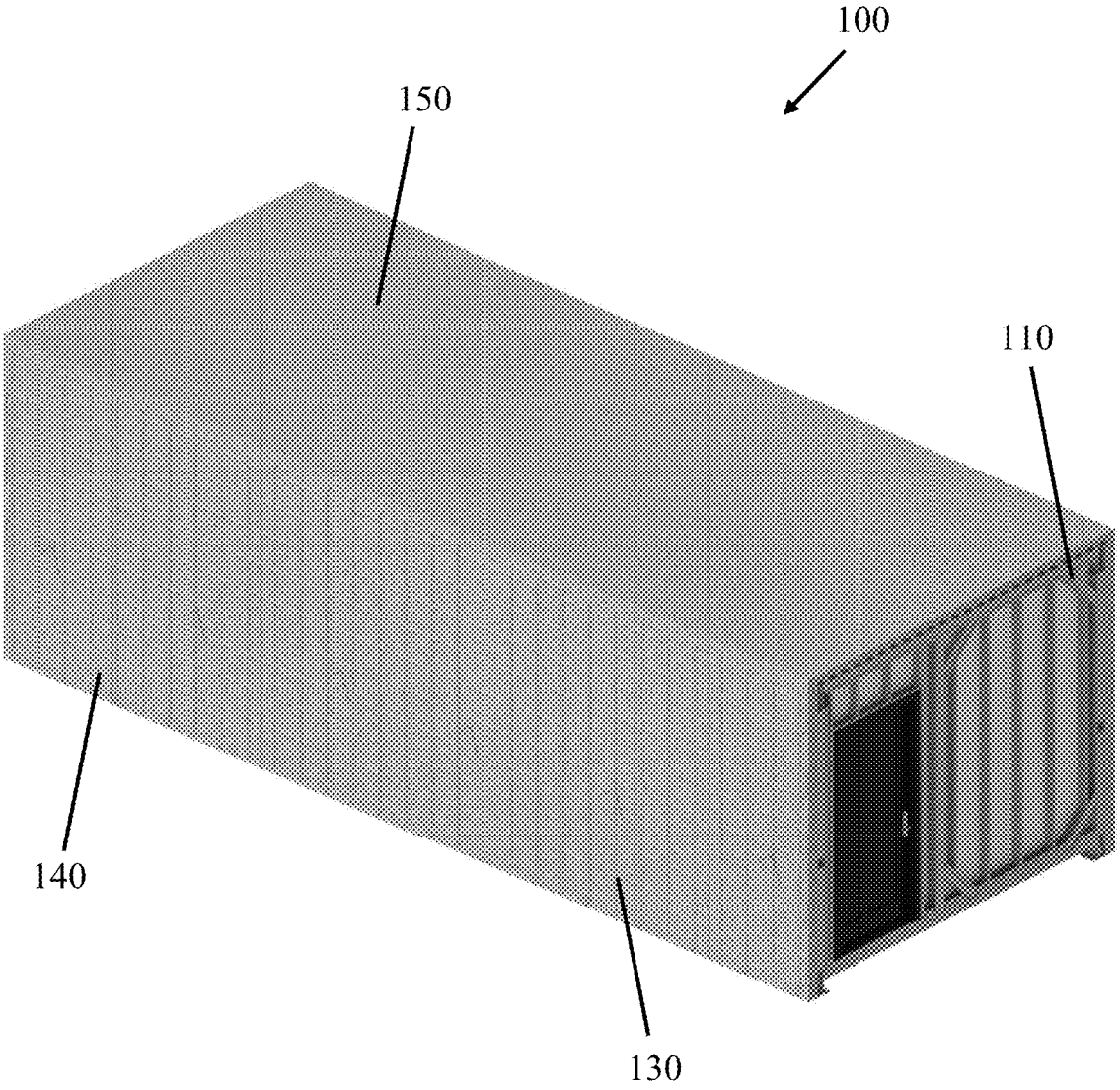
FIG. 1 is a perspective view of a concrete void form, according to an embodiment.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and, in some instances, proportions may have been exaggerated in order to more clearly depict certain features of the invention.

According to an embodiment, a concrete void form 100 is provided to enable structures to be built from pre-constructed modules to create the permanent formwork for a concrete superstructure. Accordingly, concrete void form 100 may obviate and/or reduce the need for conventional concrete forming, form stripping, reshoring, and/or tarping in the construction of a building and facilitate modular construction. Accordingly, concrete void form 100 may reduce construction delays associated with inter alia curing times for concrete and reduce an amount of time required to complete a given construction project. Consequently, concrete void form 100 may be especially beneficial after natural disasters like tornadoes, hurricanes, earthquakes, tsunamis, or pandemics or after manmade disasters like war, where hospitals and housing must be constructed quickly. Concrete void form 100 may also reduce costs associated with a given construction project by reducing labour costs and material costs and by contributing to the faster completion of revenue-generating properties. Further, concrete void form 100 may reduce waste associated with traditional concrete forming, form stripping and/or reshoring. Concrete void form 100 may be constructed off-site and may be subject to permit requirements distinct from those applied to the erection of structures on-site, thereby enabling the advancement of a given project while awaiting issuance of one or more permits, again saving time and costs necessarily associated with that time.

Figure 2:
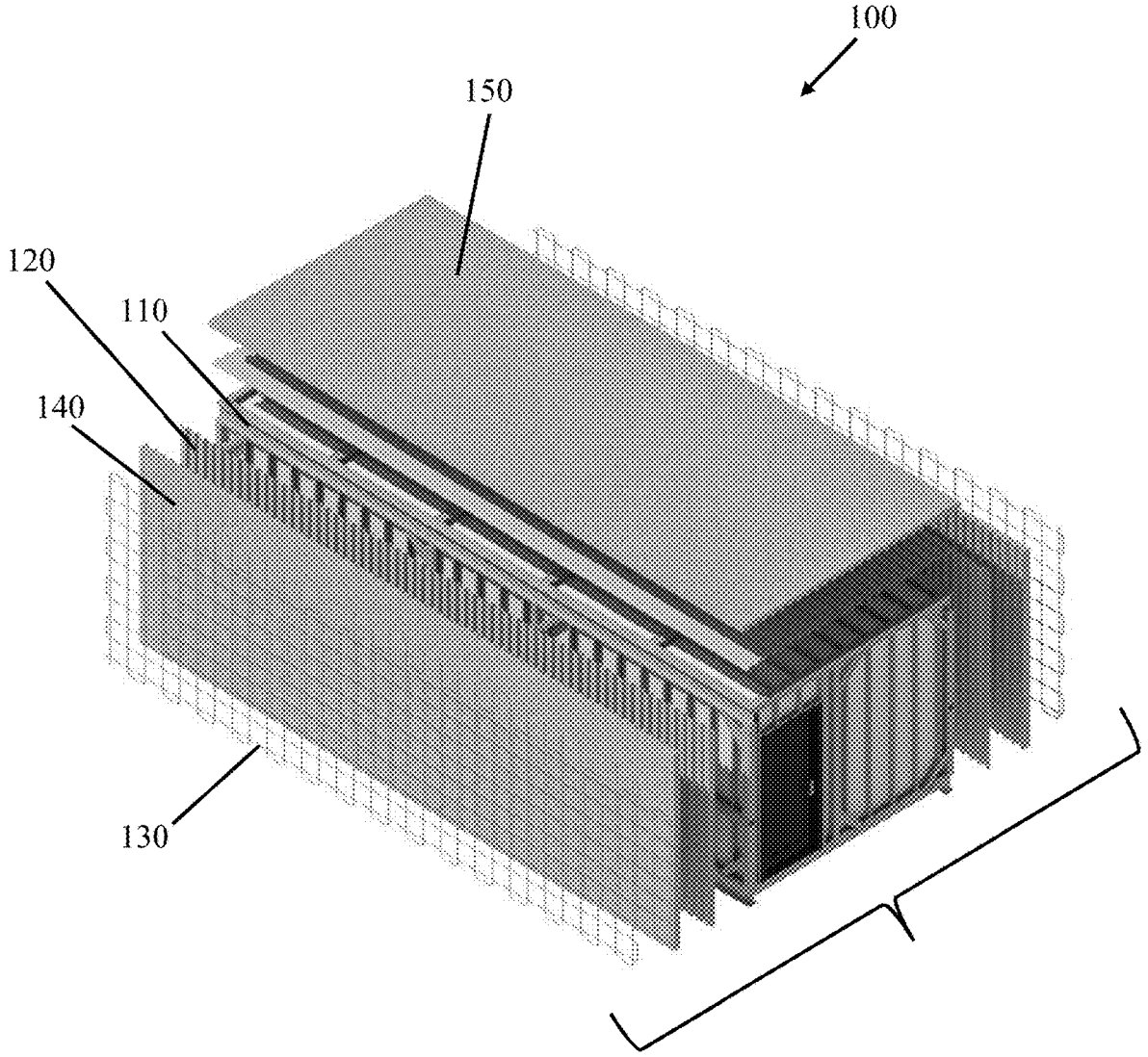
FIG. 2 is an exploded view of the concrete void form of FIG. 1.
Figure 3:
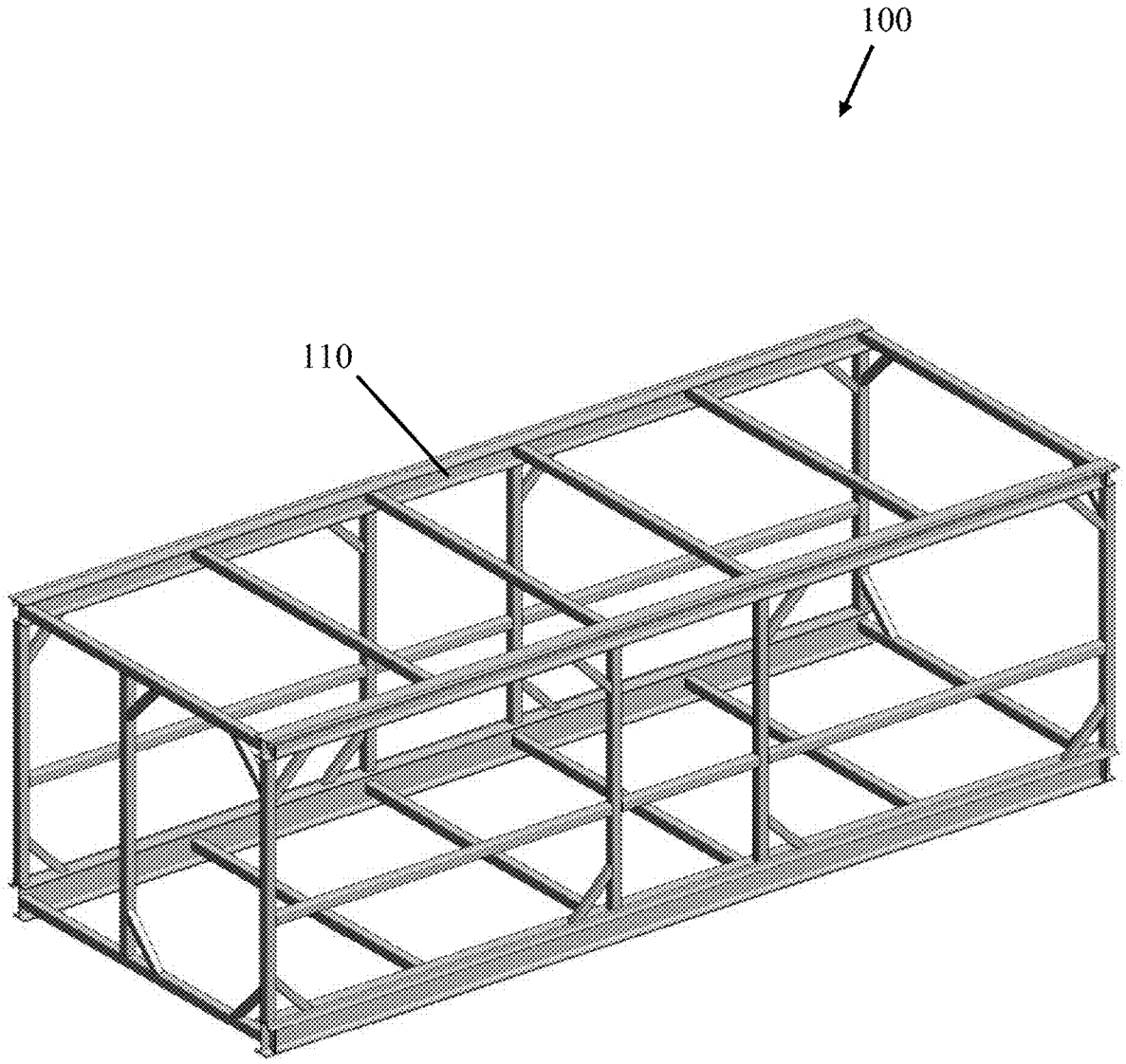
FIG. 3 is a perspective view of a concrete void form, according to an embodiment, in which the corrugated steel decking is not shown.
Figure 4:
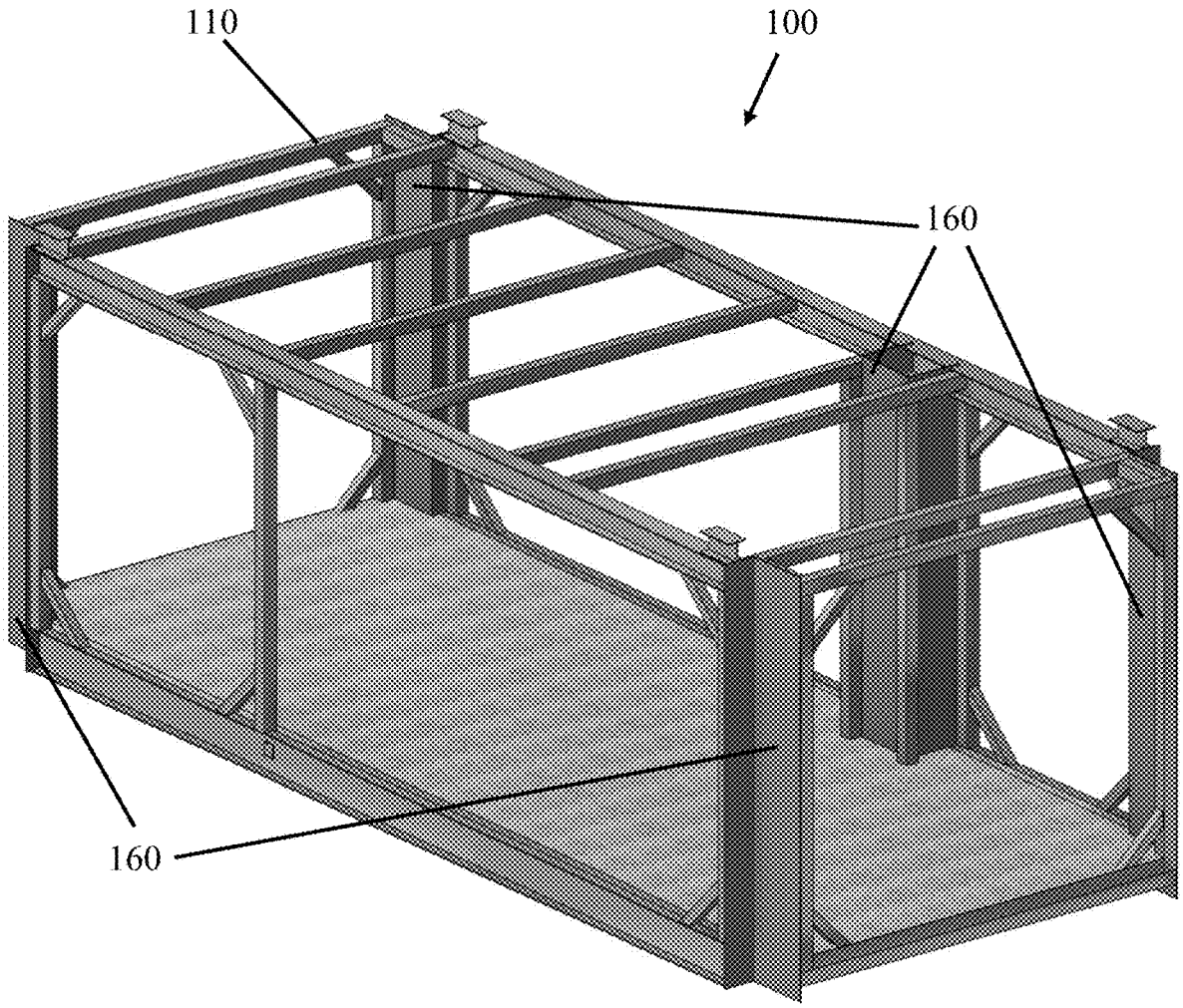
FIG. 4 is a perspective view of a concrete void form, according to another embodiment, in which the corrugated steel decking is not shown.
Figure 5:
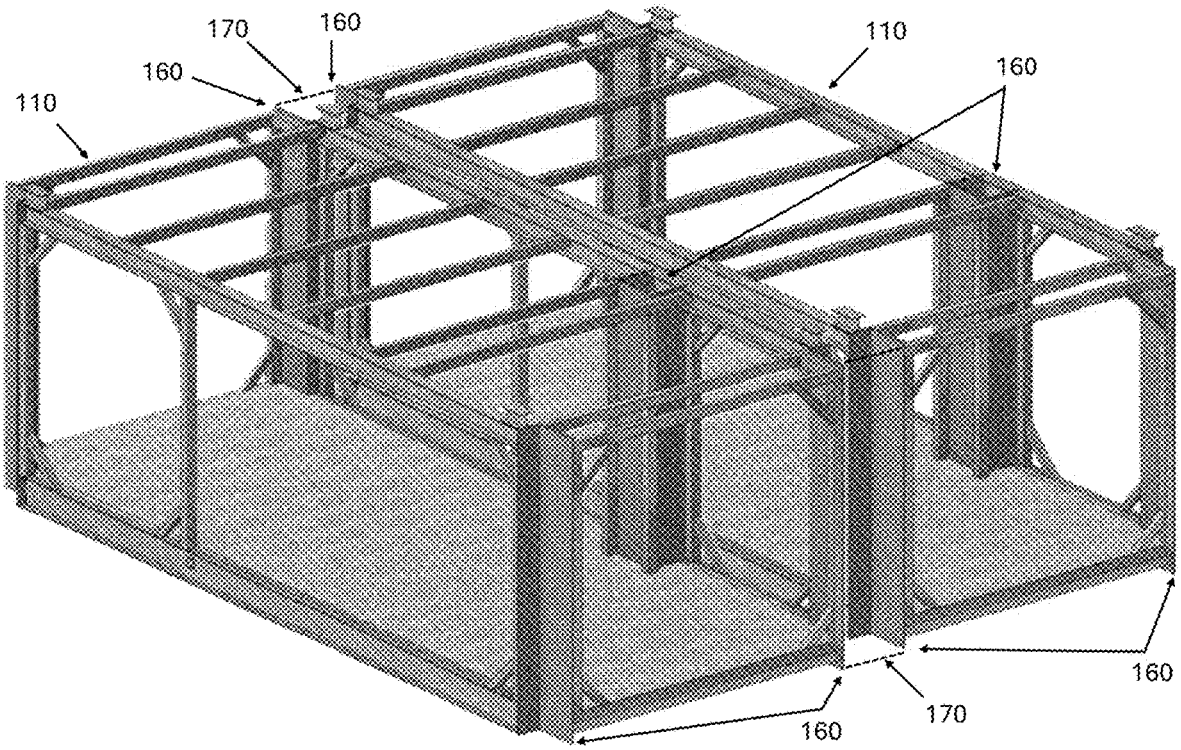
FIG. 5 is a perspective view of two concrete void forms installed adjacent to each other, according to an embodiment.

As shown in FIG. 2, concrete void form 100 comprises a steel frame 110 having a top face, a bottom face, and four side faces, wherein at least one of the four side faces and the top face are covered with at least one sheet of corrugated steel decking 120. Steel frame 110 can also be seen in FIG. 3. Steel frame 110 may comprise at least two steel tubes and two steel beams. According to an embodiment, at least one sheet of corrugated steel decking 120 comprises at least one of 16-gauge composite steel decking and 20-gauge corrugated steel decking. A set of requirements for a given project and/or a location of concrete void form 100 within a larger structure may inform a choice of gauge of at least one sheet of corrugated steel decking 120. At least one sheet of corrugated steel decking 120 may comprise at least four sheets of corrugated steel decking, one sheet for each of three of the four side faces and the top face. At least one sheet of corrugated steel decking 120 may be fastened to steel frame 110 by way of one or more of screwing, shooting and welding. A size and shape of each of steel frame 110 and sheet of corrugated steel decking 120 may vary. Steel frame 110 may be L-shaped or may be rectangular, as shown in FIGS. 1-3. At least one concrete void form 100 may further comprise at least one bent steel plate 160, as shown in FIG. 4. At least one bent steel plate 160 may form part of and be installed within steel frame 110, as shown in FIG. 5. Where concrete void form 100 and steel frame 110 are to include one or more interior columns 170, the one or more interior columns 170 may be shaped, constructed and installed into steel frame 110 with at least one bent steel plate 160.

According to an embodiment, as shown in FIGS. 1 and 2, concrete void form 100 further comprises at least one of rebar mat 130 and tied rebar (not shown), affixed to concrete void form 100 parallel to a surface of at least one sheet of corrugated steel decking 120. A size and shape of rebar mat 130 may vary. According to an embodiment, a size and shape of rebar mat 130 corresponds to a size and shape of at least one sheet of corrugated steel decking 120, as shown in FIGS. 1 and 2. Rebar mat 130 may comprise at least four rebar mats. According to an embodiment, the at least four rebar mats are disposed along at least the top face and three of the four side faces of steel frame 110. Rebar mat 130 may be configured to a set of specifications for a project in which concrete void form 100 will be used. By way of example only, a high-rise building within a seismic region will need more and larger rebar mat 130 than a low-rise building in a location with fewer seismic requirements. By way of further example, a concrete column or pier may have different rebar mat 130 and tied stirrups then a shear wall or other structural element.

According to an embodiment, as shown in FIGS. 1 and 2, concrete void form 100 further comprises at least one cast-in-place concrete wall 140 in front of the at least one sheet of corrugated steel decking covering at least one of the four side faces. A size and thickness of at least one cast-in-place concrete wall 140 may vary. A set of requirements for a given project may inform a choice of size and thickness of at least one cast-in-place concrete wall 140. According to an embodiment, at least one cast-in-place concrete wall 140 comprises at least two cast-in-place concrete walls.

According to an embodiment, as shown in FIGS. 1 and 2, concrete void form 100 further comprises a cast-in-place concrete top layer 150 above the top face and at least one sheet of corrugated steel decking 120. A size and thickness of cast-in-place concrete top layer 150 may vary. A set of requirements for a given project may inform a choice of size and thickness of cast-in-place concrete top layer 150.

According to an embodiment, there is provided a method of modular construction comprising: constructing at least one concrete void form, the at least one concrete void form comprising a steel frame having a top face, bottom face and four side faces, wherein at least one of the four side faces and the top face are covered with at least one sheet of corrugated steel decking; installing the at least one concrete void form at a construction site; and pouring concrete over or adjacent to the at least one concrete void form. According to another embodiment, the at least one sheet of corrugated steel decking comprises at least one of 16-gauge composite steel decking and 20-gauge composite steel decking. The at least one sheet of corrugated steel decking, and the steel frame, are engineered to withstand the pressure of poured concrete. According to an embodiment, the at least one concrete void form further comprises at least one bent steel plate.

The step of constructing the at least one concrete void form may comprise at least one of welding and bolting together at least two steel tubes and at least two steel beams. One or more of a size, orientation, and thickness of the at least two steel tubes and the at least two steel beams may be selected based on one or more of a set of specifications for a project within which the at least one concrete void form will be installed and a specific location within a building where the at least one concrete void form will be installed. According to an embodiment, the at least two steel beams form a top rail and a bottom rail of the at least one concrete void form and the at least two steel tubes are welded in and form upright and horizontal components of the at least one concrete void form, creating a modular box shape. A set of dimensions and components of at least one concrete void form may vary depending on a set of specifications for a project employing the at least one concrete void form.

As shown in FIG. 5, the at least one concrete void form may comprise a plurality of concrete void forms. The plurality of concrete void forms may comprise concrete void forms of different shapes. According to an embodiment, the plurality of concrete void forms is connected by at least one of welding and bolting. According to an embodiment, the plurality of concrete void forms is bolted together using structural bolts and jumper plates. A set of specifications of the structural bolts may vary. The structural bolts may be selected based on a set of specifications for a given project.

According to a further embodiment, the method of modular construction further comprises connecting the plurality of concrete void forms with threaded rod ties. The threaded rod ties may be specifically designed for use in a particular position along the plurality of concrete void forms. The threaded rod ties may be spaced 48" apart. According to an embodiment, the threaded rod ties are constructed of ¾" threaded rod. Connecting the plurality of concrete void forms with threaded rod ties may prevent shifting, separation and/or bowing of the plurality of concrete void forms before, during and/or after concrete pouring. The threaded rod ties may also support the live load of cast-in-place concrete poured over the plurality of concrete void forms.

According to an embodiment, the method of modular construction further comprises affixing at least one of rebar mat and tied rebar to at least one of the four side faces and the top face, parallel to the at least one sheet of corrugated steel decking. At least one rebar mat may be affixed to at least one of the four side faces and the top face, parallel to the at least one sheet of corrugated steel decking, by at least one of welding and tying at least one rebar mat to the steel frame.

According to an embodiment, the method of modular construction further comprises installing at least one additional concrete void form adjacent to the at least one concrete void form; and pouring concrete over or adjacent to the at least one additional concrete void form.

The method of modular construction may further comprise installing at least one upper concrete void form on top of the concrete and the at least one concrete void form. The step of installing at least one upper concrete void form on top of the concrete and the at least one concrete void form may be completed before the concrete cures, thereby potentially expediting construction. Once cured, the poured concrete may act as a strong structural frame for the stacked concrete void forms.

The method of modular construction may further comprise finishing an interior of the at least one concrete void form with at least one of steel studs, insulation, doors and trim, electrical, plumbing, HVAC, drywall, millwork, flooring, lighting and plumbing fixtures, finishes and furnishings, and thereby potentially expediting construction and reducing an amount of time between beginning construction and having a move-in ready, fully operational apartment, office, hospital or other building.

According to an embodiment, the method of modular construction may further comprise transporting the concrete void form to the construction site. The step of constructing at least one concrete void form may be completed off-site, thereby making available the benefits of a manufacturing and mass production facility to create concrete superstructures of all kinds. Consequently, construction of the at least one concrete void form may not be subject to delays associated with inclement weather; workers can perform the work in a sheltered, safe, comfortable, and controlled environment; and the at least one concrete void form is protected from precipitation during construction. Completing construction of the at least one concrete void form off-site may reduce a quantity of material and personnel required at a given construction site, thereby reducing the environmental impact, costs and other challenges associated with same. According to an embodiment, the step of constructing at least one concrete void form is completed in an at least one of a temperature-controlled environment and a humidity-controlled environment. Construction of the at least one concrete void form in at least one of a temperature-controlled environment and a humidity-controlled environment.

Various embodiments of the invention have been described in detail. Since changes in and or additions to the above-described best mode may be made without departing from the nature, spirit or scope of the invention, the invention is not to be limited to those details but only by the appended claims. Section headings herein are provided as organizational cues. These headings shall not limit or characterize the invention set out in the appended claims.

What is claimed is:

1. A method of modular construction comprising:

constructing a first concrete void form, the first concrete void form comprising a vertically extending first bent steel plate and a first steel frame having a top face, bottom face and four side faces, wherein a first side face of the four side faces and the top face of the first steel frame are covered with a first sheet of corrugated steel decking, the vertically extending first bent steel plate extending inwardly with respect to the first side face of the first concrete void form;

installing the first concrete void form at a construction site;

constructing a second concrete void form, the second concrete void form comprising a vertically extending second bent steel plate and a second steel frame having a top face, bottom face and four side faces, wherein a first side face of the four side faces and the top face of the second steel frame are covered with a second sheet of corrugated steel decking, the vertically extending second bent steel plate extending inwardly with respect to the first side face of the second concrete void form;

installing the second concrete void form at the construction site adjacent to the first side face of the first steel frame and aligning the first bent steel plate with the second bent steel plate to form a rectangular columnar gap, the first side face of the second steel frame being on a proximal side of the second concrete void form with respect to the first side face of the first steel frame;

providing a rebar mat between the first concrete void form and the second concrete void form such that the rebar mat is positioned immediately between the first sheet of corrugated steel decking on the first side face of the first steel frame and the second sheet of corrugated steel decking on the first side face of the second steel frame; and pouring concrete between the first concrete void form and the second concrete void form to allow the concrete to fill a gap between the first sheet of corrugated steel decking and the second sheet of corrugated steel decking enveloping the rebar mat and forming a rectangular concrete column between the first concrete void form and the second concrete void form with a thickness greater than a thickness of a cast-in-place concrete wall formed by pouring concrete between the first concrete void form and the second concrete void form.

2. The method of claim 1, wherein the first and second sheets of corrugated steel decking are each formed of at least one of 16-gauge composite steel decking and 20-gauge composite steel decking.

3. The method of claim 1, further comprising installing at least one upper concrete void form on top of the first concrete void form before the poured concrete cures.

4. The method of claim 1, wherein the construction of the first and second concrete void forms is completed off-site of the construction site.

5. The method of claim 4, wherein the step of constructing the first and second concrete void forms is completed in an at least one of a temperature-controlled environment and a humidity-controlled environment that is not the construction site.

6. The method of claim 1, wherein the step of installing the second concrete void form includes affixing the second concrete void form to the first concrete void form by at least one of welding and bolting.

7. The method of claim 1, wherein the step of installing the second concrete void form includes affixing the second concrete void form to the first concrete void form with threaded rod ties.

8. The method of claim 1, further comprising finishing an interior of the first and second concrete void forms with at least one of steel studs, insulation, doors and trim, electrical, plumbing, HVAC, drywall, millwork, flooring, lighting and plumbing fixtures, finishes and furnishings.

9. The method of claim 1, wherein the first steel frame and the second steel frame are each composed of at least two steel tubes and two steel beams.

* * * * *